US009530389B2

(12) United States Patent
Moffat

(10) Patent No.: US 9,530,389 B2
(45) Date of Patent: Dec. 27, 2016

(54) SYSTEMS AND METHODS FOR HOLDING AN INSTRUMENT PICK

(71) Applicant: James Ernest Moffat, Marysville, WA (US)

(72) Inventor: James Ernest Moffat, Marysville, WA (US)

( * ) Notice: Subject to any disclaimer, the term of this patent is extended or adjusted under 35 U.S.C. 154(b) by 0 days.

(21) Appl. No.: 15/001,868

(22) Filed: Jan. 20, 2016

(65) Prior Publication Data

US 2016/0217773 A1 Jul. 28, 2016

Related U.S. Application Data

(60) Provisional application No. 62/125,455, filed on Jan. 23, 2015.

(51) Int. Cl.
*G10D 3/16* (2006.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS 413,579 A * 10/1889 Stewart ..... G10D 3/163 273/129 R
1,557,476 A * 10/1925 Kimball et al. ..... G10D 3/163 84/322
3,648,558 A * 3/1972 Chenette ..... G10D 3/163 84/322
3,699,838 A * 10/1972 Montgomery ..... G10D 3/163 84/322
4,270,433 A * 6/1981 Adamec ..... B01F 17/0064 84/322
4,497,237 A * 2/1985 Beall ..... G10D 3/163 84/322
4,625,616 A * 12/1986 McVicker ..... G10D 3/163 84/322
4,867,032 A * 9/1989 Lukehart ..... G10D 3/163 84/322
D392,668 S * 3/1998 Shingler ..... 84/322
6,127,613 A 10/2000 Hansel
D436,984 S * 1/2001 Hansel ..... 84/322
7,371,950 B2 * 5/2008 Benyahia ..... G10D 3/163 84/320

(Continued)

*Primary Examiner* — Robert W Horn
(74) *Attorney, Agent, or Firm* — Michelle E. Carey; Telekta Law, P.S.

(57) ABSTRACT

A device configured for holding a plectrum to a user's hand. The device includes a loop end and a pick end, the loop end configured to be disposed over a user's thumb, and the pick end configured to hold at least one pick. The pick end may include adhesive or an area of higher friction by which the pick is coupled with the device. The pick end may include a cavity configured for receiving the pick. The cavity may be substantially rigid, configured to fit a particular shape and size of plectrum. The cavity may be substantially flexible, configured to receive plectra of different shapes and sizes. The pick end and loop end may be a single unit. The pick end may be removably coupleable with the loop end, allowing a user to prepare multiple pick ends or to interchange an adhesive pick end with a cavity pick end.

11 Claims, 6 Drawing Sheets

(56) References Cited

U.S. PATENT DOCUMENTS

| | | | | |
|---|---|---|---|---|
| 8,492,630 | B1 * | 7/2013 | Wonnacott | G10D 3/163<br>84/320 |
| 2009/0139384 | A1 * | 6/2009 | Bramucci | G10D 3/163<br>84/322 |
| 2009/0229442 | A1 * | 9/2009 | Hollin, Jr. | G10D 3/163<br>84/322 |
| 2016/0217773 | A1 * | 7/2016 | Moffat | G10D 3/163 |

* cited by examiner

SYSTEMS AND METHODS FOR HOLDING AN INSTRUMENT PICK

FIELD OF THE INVENTION

This invention relates generally to music, and, more specifically, to picking devices.

BACKGROUND OF THE INVENTION

Many instruments, such as guitars and banjos, are played by a picking of the strings of the instrument, whether by finger or by an artificial picking device. Most standard picks are thin, substantially triangularly shaped pieces of rigid or semi-rigid material, such as plastic. They can be easily dropped or lost during a performance. Many past inventions have attempted to make a pick easier for a musician to hold, and each has had its limitation. U.S. Pat. No. 6,127,613, for instance, is rigid, forcing the user to hold the pick in a particular position, which may not be the musician's preferred position. Others may be incompatible with picks of different gauges, forcing a user to play with picks that are lighter or heavier than they prefer. Still others, such as that disclosed in U.S. Pat. No. 3,648,558 may require a built-in pick, again confining the user to pick types that may be foreign or less preferred, and restricting the user to particular positions. Moreover, some past attempts have aspects that change the nature of the pick, such as the straps on the pick itself disclosed in the U.S. Pat. No. 3,648,558 patent, which can alter the tone of the instrument.

SUMMARY OF THE INVENTION

This invention relates generally to music, and, more specifically, to picking devices.

The loop is an elliptical loop which passes laterally over, and rests around the proximal segment of the user's thumb. When the invention is rotated into the proper playing position, the pick is affixed onto the thumb. Extending from the loop is a central bridge, in some embodiments narrow enough to be highly flexible, which further extends to the pick support section. The pick support section may include an adhesive area or a pick cavity portion. This portion may contain a recessed cavity, sized to receive and hold any standard sized variety of commercially available plectra. The pick support portion is held on its flat surfaces between the user's thumb and index finger. The loop adds leverage and additional points of contact to the hand. The result is increased stability of use, even when held loosely. When the user chooses to change to a finger-picking style, they can simply release the pick, which immediately moves away, allowing unobstructed use of the fingers. When the user chooses to resume using the pick, its proximity affords easy and immediate re-deployment.

The device disclosed herein offers many advantages to users, such as: it is virtually un-droppable; it can be released without being dropped and immediately re-deployed at will; it allows immediate changes in playing style from finger-picking to strumming; it allows for fret-tapping and various hand techniques without loss; it can be used by players with physical challenges to the hand; it can be used players with certain other medical challenges; it can be used by players whose thumb is partially missing or paralyzed; it requires virtually no grip to use, yet can be gripped as tightly as desired; it enhances playing speed and reduces grip fatigue; it can be released to use the hand for other purposes or adjustments; it is easily mountable and removable; it is unobtrusive and comfortable; it can be stored on the tuning keys of the guitar; it allows the user to select and use picks of various thicknesses and characteristics; it allows for simple replacement of any pick which might fail of break; it automatically holds the pick in the proper playing position; it can be used by left or right-handed players without re-configuration; it can be virtually forgotten while worn on the hand, and never be lost.

In addition to the foregoing, various other methods, systems and/or program product embodiments are set forth and described in the teachings such as the text (e.g., claims, drawings and/or the detailed description) and/or drawings of the present disclosure.

The foregoing is a summary and thus contains, by necessity, simplifications, generalizations and omissions of detail; consequently, those skilled in the art will appreciate that the summary is illustrative only and is NOT intended to be in any way limiting. Other aspects, embodiments, features and advantages of the device and/or processes and/or other subject matter described herein will become apparent in the teachings set forth herein.

BRIEF DESCRIPTION OF THE DRAWINGS

Certain embodiments of the present invention are described in detail below with reference to the following drawings.

DETAILED DESCRIPTION

This invention relates generally to music, and, more specifically, to picking devices.

Specific details of certain embodiments of the invention are set forth in the following description and in FIGS. 1-8 to provide a thorough understanding of such embodiments. The present invention may have additional embodiments, may be practiced without one or more of the details described for any particular described embodiment, or may have any detail described for one particular embodiment practiced with any other detail described for another embodiment.

Importantly, a grouping of inventive aspects in any particular "embodiment" within this detailed description, and/or a grouping of limitations in the claims presented herein, is not intended to be a limiting disclosure of those particular aspects and/or limitations to that particular embodiment and/or claim. The inventive entity presenting this disclosure fully intends that any disclosed aspect of any embodiment in the detailed description and/or any claim limitation ever presented relative to the instant disclosure and/or any continuing application claiming priority from the instant application (e.g. continuation, continuation-in-part, and/or divisional applications) may be practiced with any other disclosed aspect of any embodiment in the detailed description and/or any claim limitation. Claimed combinations which draw from different embodiments and/or originally-presented claims are fully within the possession of the inventive entity at the time the instant disclosure is being filed. Any future claim comprising any combination of limitations, each such limitation being herein disclosed and therefore having support in the original claims or in the specification as originally filed (or that of any continuing application claiming priority from the instant application), is possessed by the inventive entity at present irrespective of whether such combination is described in the instant specification because all such combinations are viewed by the inventive entity as currently operable without undue experimentation given the disclosure herein and therefore that any such future claim would not represent new matter.

Figure 1:
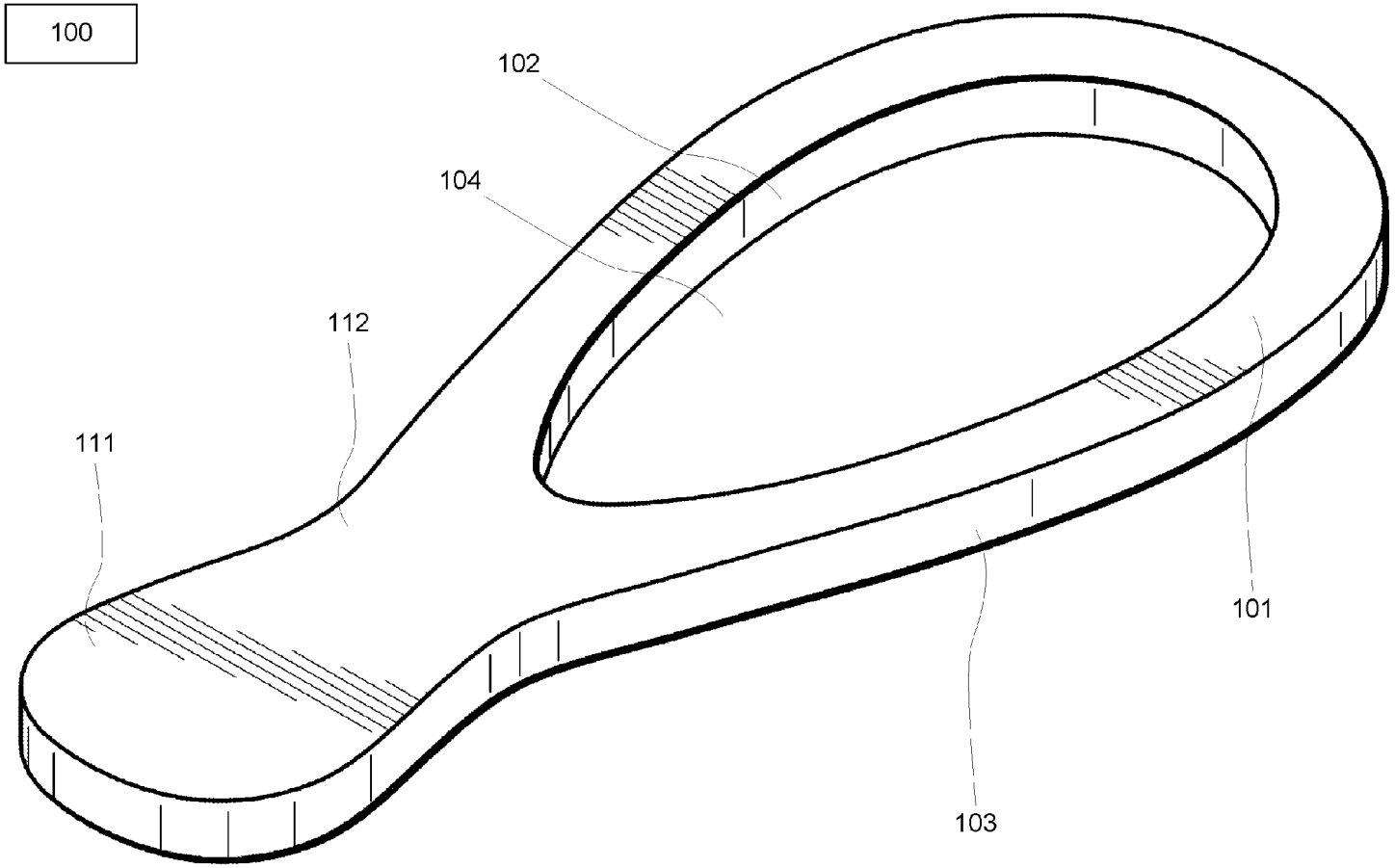
FIG. 1 is an isometric view of one embodiment of the picking device.

FIG. 1 is an isometric view of one embodiment of the picking device 100. The device is comprised essentially of a loop 101 and a pick support 111.

In some embodiments, loop 101 may be comprised of an inner perimeter 102 and an outer perimeter 103. In some embodiments, inner perimeter 102 may form an elongated hole 104. In some embodiments, hole 104 may be substantially elliptical or ovoid. In other embodiments, hole 104 may be substantially circular. In still other embodiments, hole 104 may be in a decorative shape, such as holiday shapes, stars, or a logo or portion of a logo for a musician or band. While some shapes, such as elliptical, represent a preferred embodiment, it should be understood that the hole 104 could be any shape without altering the function of the hole.

In some embodiments, loop 101 may be comprised of a semi-flexible material, such as rubber, latex, polyethylene, plastic, nylon, or other substantially flexible or semi-flexible material. In some embodiments, loop 101 may be comprised of stretchable or semi-stretchable material, such as nylon or elastic. This would allow the loop 101 to be elongated for application and removal, while constricting during use for a secure fit.

One purpose of loop 101 is to add additional points-of-contact between the picking device, the pick, or plectrum, itself, and the hand of the user. The result is increased stability of use, even when the pick is held loosely. Another purpose of loop 101 is to allow a user to simply release the pick when the user wishes to finger-pick. The pick immediately moves away, allowing unobstructed use of the fingers, and when the player chooses to resume using the pick, it is easily returned to the user's hand. Another purpose of loop 101 is to prevent unintentional loss of the plectrum during use, which can negatively impact the intended performance of the user. Another purpose of loop 101 is to allow users with limited thumb functionality to grip a pick for playing of stringed instruments. In some embodiments, loop 101 may be sized to slide laterally over the primary knuckle of the thumb. When rotated into playing position, and held between the pads of the thumb and index finger, its inner perimeter 102 will be in transverse position to the natural anatomical ellipse of the knuckle, thus providing affixation to the thumb.

In some embodiments, picking device 100 may include pick support 111. In some embodiments, pick support 111 may be substantially square in shape, lending to ease of manufacturing. In other embodiments, pick support 111 may be substantially circular in shape. In preferred embodiments, pick support 111 may be an elongated tab with rounded edges to lend comfort for the user. In some embodiments, pick support 111 may be coupled with loop 101 via bridge 112. In some embodiments, bridge 112 may be substantially flexible to allow a user to easily position the pick in a preferred manner. In other embodiments, bridge 112 may be semi-flexible, to allow a user to position the pick in a preferred manner while still lending additional support and stability to the pick. This particular embodiment may be beneficial for users with diminished function in their hands or fingers. In still other embodiments, bridge 112 may be semi-rigid or substantially rigid, configured in a position customized to an individual player's preference. This particular embodiment may be beneficial for users with limited function or mobility in their hands or fingers, and for users who may be missing a thumb, forefinger, or middle finger on their playing hand.

In preferred embodiments, all of loop 101, pick support 111, and bridge 112 may be comprised of the same material, cut from or extruded as a single unit. In other embodiments, loop 101, pick support 111, and bridge 112 may be individual units. In still other embodiments, two of the three may be a single unit, such as loop 101 and bridge 112, wherein the third unit, such as support 111, may be removably coupleable.

Figure 2:
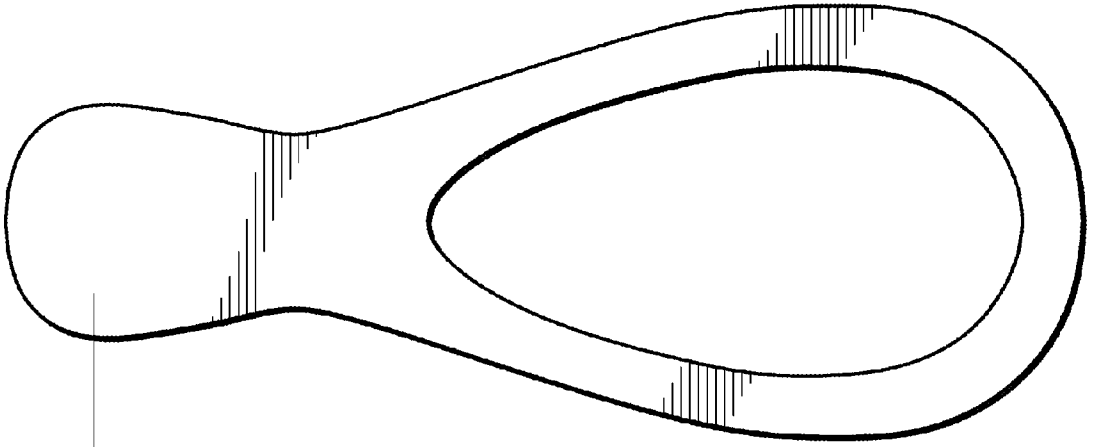
FIG. 2 is a bottom view thereof.
Figure 3:
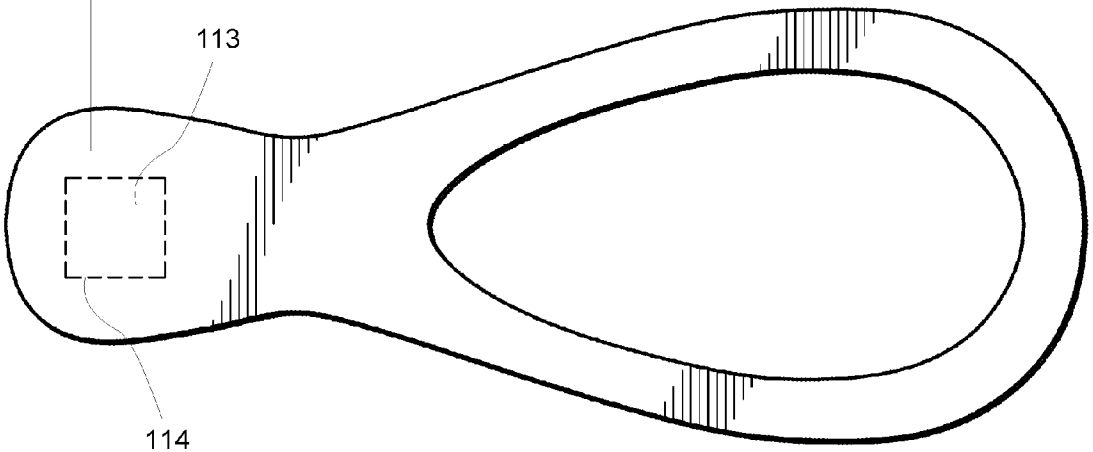
FIG. 3 is a top view thereof.

FIG. 2 is a bottom view of one embodiment of the picking device, and FIG. 3 is a top view thereof. Support 111 is shown in both figures. FIG. 3 also depicts the pick coupling area 113 that may be disposed on support 111 in some embodiments. One benefit of pick coupling area 113 is that it may be used to couple picking device 100 with any commercially available pick which the user may prefer, rather than requiring the user to use a built-in pick or picking material. In some embodiments, pick coupling area 113 may be an area on which an adhesive is disposed. In preferred embodiments, area 113 may be a designated portion onto which a user can place double-sided adhesive. In a further embodiment, the designated portion may be formed by a perimeter 114, which may be any shape, but is depicted as a square for illustrative purposes. In some embodiments, area 113 may be an area with a higher coefficient of friction, allowing a pick to be gripped and held in place by virtue of friction between the pick material and the area material. In still other embodiments, area 113 may include one half of a fastening material, such as the hook portion of a hook-and-loop fastener or the male half of a snap, wherein the pick may include the other half of the fastening material, such as the loop portion of a hook-and-loop system or the female half of a snap.

Figure 4:
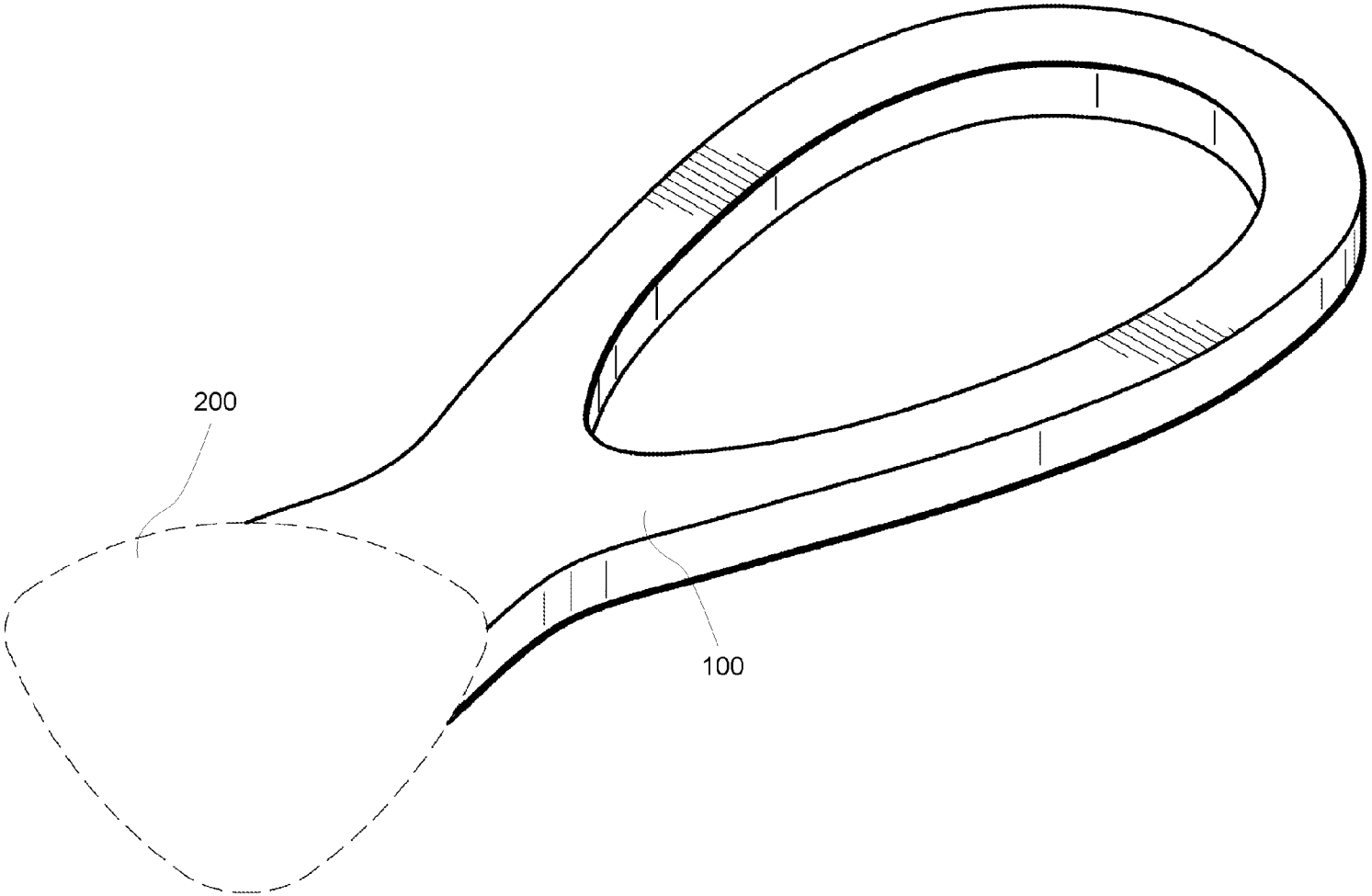
FIG. 4 is an environmental view thereof.

FIG. 4 is an environmental view showing pick 200 in place on picking device 100, coupled by at least one of the means described herein. While only one pick 200 is shown in FIG. 4, it should be noted that, in some embodiments, a user may be able to attach multiple picks to support 111. This would be beneficial to the user because the user could have immediate access to backup picks if the first broke. Moreover, a user may be able to have picks of multiple gauges in use at the same time, allowing the user to easily switch between picks of different gauges to achieve different sounds.

Figure 5:
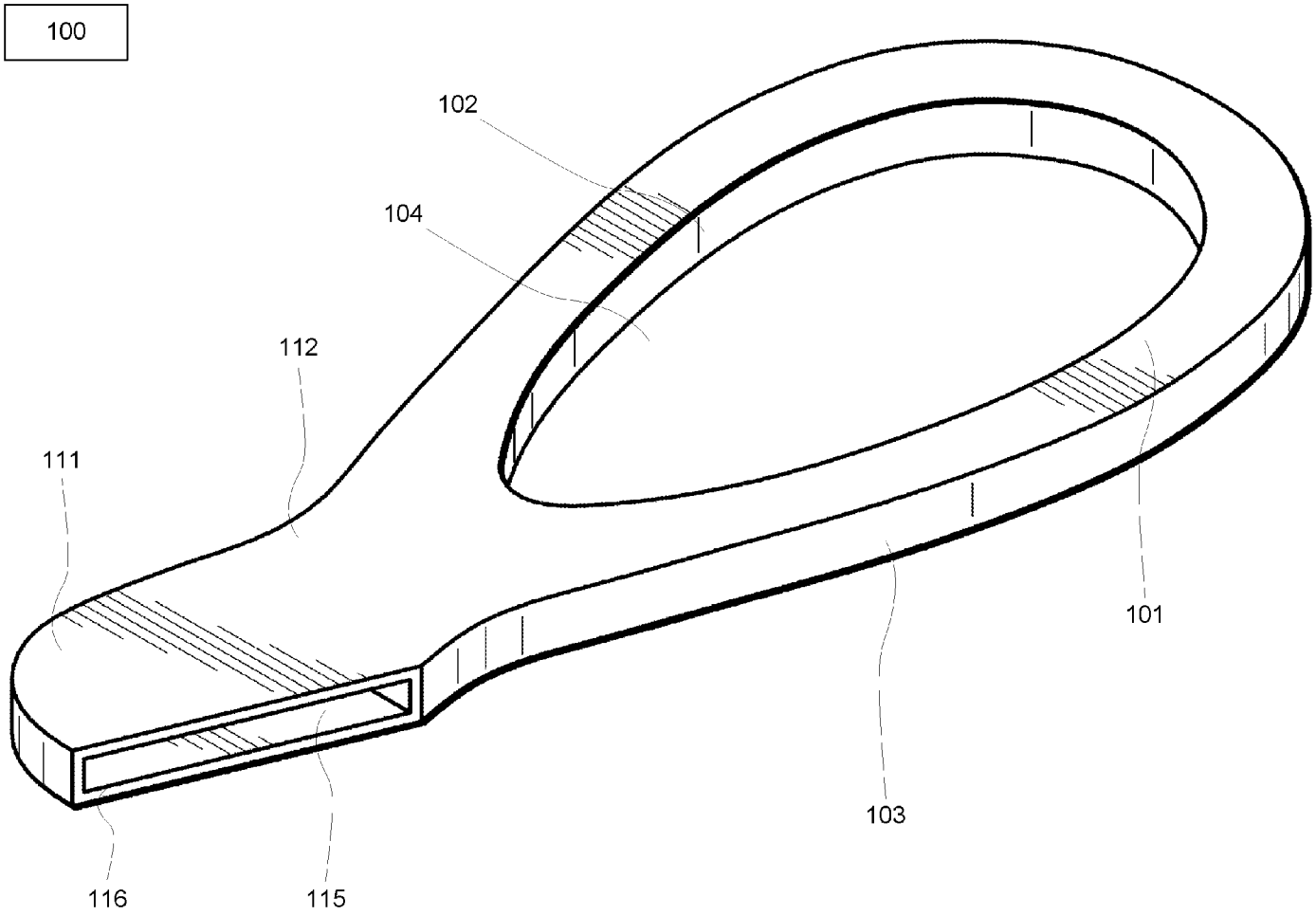
FIG. 5 is an isometric view of one embodiment of the picking device.

FIG. 5 is an isometric view of an alternative embodiment of the picking device 100.

In some embodiments, loop 101 may be comprised of an inner perimeter 102 and an outer perimeter 103. In some embodiments, inner perimeter 102 may form an elongated hole 104. In some embodiments, hole 104 may be substantially elliptical or ovoid. In other embodiments, hole 104 may be substantially circular. In still other embodiments, hole 104 may be in a decorative shape, such as holiday shapes, stars, or a logo or portion of a logo for a musician or band. While some shapes, such as elliptical, represent a preferred embodiment, it should be understood that the hole 104 could be any shape without altering the function of the hole.

In some embodiments, loop 101 may be comprised of a semi-flexible material, such as rubber, latex, polyethylene, plastic, nylon, or other substantially flexible or semi-flexible material. In some embodiments, loop 101 may be comprised of stretchable or semi-stretchable material, such as nylon or elastic. This would allow the loop 101 to be elongated for application and removal, while constricting during use for a secure fit.

In some embodiments, picking device 100 may include pick support 111. In further embodiments, pick support 111 may include cavity 115, which may be formed by perimeter 116. In preferred embodiments, cavity 115 may be substantially elastic and flexible, such that it can be stretched over the body of a pick for secure holding thereof. In other embodiments, cavity 115 may be precisely cut to provide compression grip on any of several standard shapes for picks. Commonly purchased sizes may be 25 millimeters long by 23 millimeters wide, for picks known as "Jazz" style picks; 26 by 19 millimeters for "Teardrop" style picks; 29 by 25 millimeters for "traditional" style picks; and 31 by 32 millimeters for "Tri-Point" style picks. In some embodiments, cavity 115 may be slightly wider than a pick. In some embodiments, cavity 115 may be substantially the same width as a pick. In still other embodiments, cavity 115 may be slightly narrower than a pick. Similarly, in some embodiments, cavity 115 may be slightly deeper than a pick is long. In other embodiments, cavity 115 may be substantially the same depth as the length of a pick. In still other embodiments, cavity 115 may be slightly shallower than the length of a pick. In some embodiments, cavity 115 may be slightly thicker than the thickness of a pick. In other embodiments, cavity 115 may be substantially the same thickness as the thickness of a pick. In still other embodiments, cavity 115 may be slightly thinner than the thickness of a pick. It should be noted that these measurements are exemplary only, and the width, depth, and thickness of opening of cavity 115 may be customizable for an individual user's preference.

Figure 6:
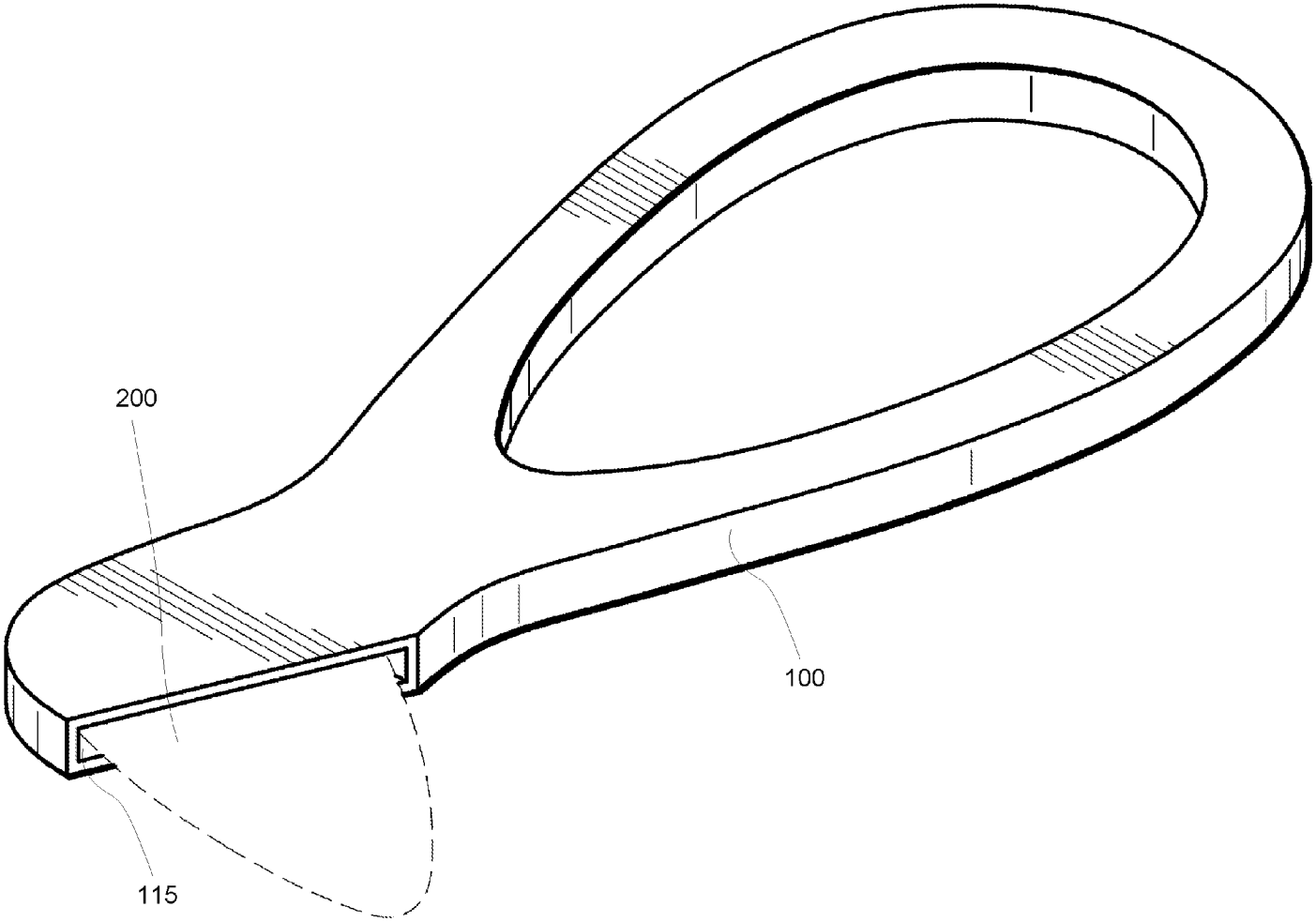
FIG. 6 is an environmental view thereof.
Figure 7:
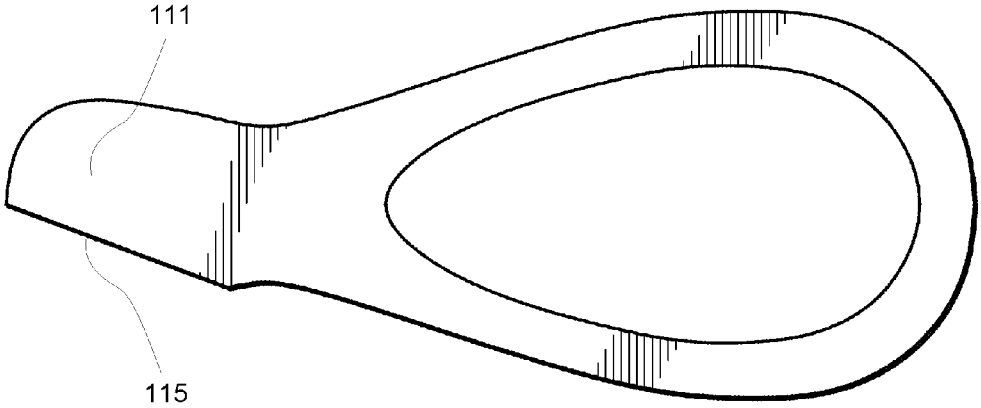
FIG. 7 is a top view thereof.
Figure 8:
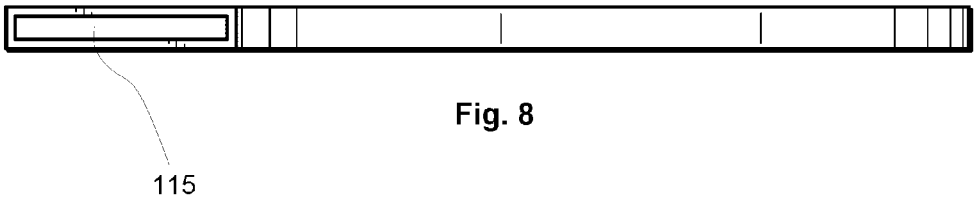
FIG. 8 is a side view thereof.

FIG. 6 is an environmental view of the alternative embodiment of picking device 100 with a pick in place in cavity 115. FIG. 7 is a top view of the alternative embodiment of picking device 100, showing that cavity 115 is formed within support 111. FIG. 8 is a side view thereof. As with the first embodiment disclosed herein, many methods of manufacture could be employed, such as injection molding, stamping, extrusion, etc. Furthermore, in preferred embodiments, all of loop 101, pick support 111, and bridge 112 may be comprised of the same material, cut from or extruded as a single unit. In other embodiments, loop 101, pick support 111, and bridge 112 may be individual units. In still other embodiments, two of the three may be a single unit, such as loop 101 and bridge 112, wherein the third unit, such as support 111, may be removably coupleable. In some embodiments, support 111 may be interchangeable, such that a user may sometimes select the support with grip area 113, and may at other times select the support with cavity 115.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of this subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A picking device comprising:

at least one substantially flexible loop, wherein the at least one substantially flexible loop is substantially oval in shape;

at least one bridge disposed at one end of the at least one loop; and at least one substantially rigid tab disposed at an end of the at least one bridge opposite the at least one loop.

2. The picking device of claim 1, further comprising:

at least one adhesive-based coupling area disposed on at least one of a top surface or a bottom surface of the at least one tab.

3. The picking device of claim 1, wherein the at least one loop further comprises:

an outer perimeter;

an inner perimeter; and a hole formed by the inner perimeter.

4. The picking device of claim 1, wherein the at least one tab further comprises:

at least one cavity disposed within the at least one tab, cavity configured to receive a wide end of a plectrum.

5. The picking device of claim 4, wherein the at least one cavity disposed within the at least one tab and configured to receive a wide end of a plectrum is further configured to orient the plectrum such that it is coplanar with the picking device.

6. The picking device of claim 4, wherein the at least one cavity configured to receive a wide end of a plectrum is further configured to exert a constrictive force on the plectrum.

7. The picking device of claim 1, wherein the at least one bridge is substantially flexible.

8. The picking device of claim 1, wherein the at least one bridge is substantially rigid.

9. The picking device of claim 1, wherein the at least one loop, the at least one bridge, and the at least one tab are permanently coupled to form a single unit.

10. A picking device comprising:

at least one substantially flexible loop with a hand end and a thumb end, wherein the hand end is comparatively wider than the thumb end, forming an oval shape;

at least one bridge disposed at the thumb end of the at least one loop, the at least one bridge including a hand end and a thumb end, wherein the hand end of the at least one bridge is coupled with the thumb end of the at least one loop; and at least one substantially rigid tab disposed at the thumb end of the at least one bridge.

11. A picking device comprising:

a substantially flexible loop forming an oval shape configured to be worn about the thumb of a user;

a flexible bridge disposed at one end of the loop; and at least one substantially rigid tab disposed at an end of the bridge opposite the loop and configured to receive a wide end of at least one standard plectrum.

* * * * *